US009475188B2

(12) United States Patent
Miller

(10) Patent No.: US 9,475,188 B2
(45) Date of Patent: Oct. 25, 2016

(54) EXTENSIBLE APPARATUS FOR LOCATING ATTACHMENT POINTS

(71) Applicant: Garold C. Miller, Glastonbury, CT (US)

(72) Inventor: Garold C. Miller, Glastonbury, CT (US)

(73) Assignee: Friends Marketing International SEZC Ltd., Georgetown (KY)

( * ) Notice: Subject to any disclaimer, the term of this patent is extended or adjusted under 35 U.S.C. 154(b) by 112 days.

(21) Appl. No.: 14/668,189

(22) Filed: Mar. 25, 2015

(65) Prior Publication Data

US 2016/0279787 A1 Sep. 29, 2016

(51) Int. Cl.
*B25C 5/00* (2006.01)
*B25H 7/04* (2006.01)

(52) U.S. Cl.
CPC ..... *B25H 7/04* (2013.01)

(58) Field of Classification Search
CPC ..... B25H 7/04; G01B 3/08
USPC ..... 33/32.1, 41.1, 332, 574, 578, 809
See application file for complete search history.

(56) References Cited

U.S. PATENT DOCUMENTS 3,628,253 A 12/1971 Shepard
4,152,838 A * 5/1979 Cook ..... G01C 9/28 33/342
4,285,135 A * 8/1981 Minozzi, Jr. ..... B23Q 9/00 33/197
4,621,431 A * 11/1986 Fatool ..... G01B 3/08 33/296
4,928,395 A * 5/1990 Good ..... G01C 9/24 33/374
5,357,683 A * 10/1994 Trevino ..... B25H 7/00 33/465
6,029,362 A 2/2000 Miodragovic
6,167,631 B1 * 1/2001 Lin ..... G01C 9/16 33/374
6,421,928 B1 7/2002 Miller
6,785,977 B1 9/2004 Crichton
7,210,243 B2 5/2007 Schmidt et
D565,440 S 4/2008 Neal
7,503,126 B2 3/2009 Robins
7,509,752 B2 3/2009 Schmidt et al.
7,513,056 B1 4/2009 Hobden et al.
7,814,675 B2 10/2010 Venderley et al.
8,286,363 B1 * 10/2012 Martinez ..... A47G 1/205 33/451
8,347,518 B1 * 1/2013 Martinez ..... A47G 1/205 33/613
8,864,095 B1 * 10/2014 Marks ..... A47G 1/16 248/323
2002/0078583 A1 6/2002 Richardson
2002/0189119 A1 * 12/2002 High ..... A47G 1/205 33/613
2003/0033722 A1 2/2003 Lanham
2004/0055168 A1 * 3/2004 Allen ..... B25H 7/04 33/42
2009/0272000 A1 * 11/2009 Hardy ..... G01B 3/08 33/809
2015/0354933 A1 * 12/2015 Moss ..... B25C 3/008 52/105

* cited by examiner

*Primary Examiner* — G. Bradley Bennett
(74) *Attorney, Agent, or Firm* — McCormick, Paulding & Huber LLP

(57) ABSTRACT

An extensible apparatus for locating attachment points includes a first end piece, a main track fixed at its proximal end to the first end piece and extending from the first end piece to its distal end, an auxiliary track extending along and extensible distally from the main track, and a auxiliary end piece fixed to the distal end of the auxiliary track. The first end piece has a flat rearward face for placement against a wall. The tracks extend in parallel with the flat rearward face of the first end piece. A main shuttle is slidably movable along the main track, and an auxiliary shuttle is slidably movable along the auxiliary track. Each shuttle includes a rearwardly protruding marker.

20 Claims, 3 Drawing Sheets

EXTENSIBLE APPARATUS FOR LOCATING ATTACHMENT POINTS

TECHNICAL FIELD

The present invention relates generally to devices for attaching fixtures to walls, and more particularly to devices for establishing two or more attachment points on a wall, such that fixtures can be attached to a wall surface at desired locations and orientations.

BACKGROUND OF THE INVENTION

Those who have attempted to install a picture, mirror, diploma, towel rack, or other wall-mounted fixture are well aware of the difficulty in locating the hook in the right position on the wall so the picture frame hangs exactly where desired. Typically, the picture frame is positioned on the wall and a location for the hook is approximated by eye, feel, or pure guesswork. But, what looks level during installation frequently appears off-kilter from across the room.

Various devices have been devised to improve the results of fixture installation and simplify the task of hanging an object on a wall. For example, the inventor's own U.S. Pat. No. 6,421,928 to Miller discloses a locating device for attaching a fixture level on a wall. The device includes an elongated body having a rear side. A first trammel is slidably mounted for movement along a longitudinal axis of the elongated body and includes a first marker extending away from a surface of the first trammel that is adjacent the rear side of the body, at an angle approximately perpendicular to the longitudinal axis. A second trammel is also slidably mounted for movement along the longitudinal axis of the elongated body and includes a second marker extending from the second trammel in about the same direction as the first marker. A first securing device is attached to the first trammel to secure it in a desired position. A second securing device is attached to the second trammel to secure it in a desired position. A level is mounted to the elongated body and has a predetermined orientation relative to an imaginary line connecting the first marker and the second marker. A side of the elongated body may include graduated markings which can be used as a guide to position the trammels at desired relative locations.

As another example, U.S. Pat. No. 6,029,362 to Miodragovic discloses an article for aligning and establishing fastening points for attachment means, such as nails, pegs and hooks, for the arrangement and hanging of pictures and picture frames, as well as for marking fastening points at either selected horizontal or vertical distances from one another for wall plates and built-in units in building construction. The disclosed alignment article includes at least one bubble level mounted in a frame, with a cursor having a first borehole guided along the frame and lying over a slit designed in the frame and running parallel to the longitudinal edges thereto, and with at least one further borehole situated at one of the ends of the frame. The cursor is constructed for grabbing the frame in a C-shape. A plurality of steps is further provided for an exact guiding on the outerlying longitudinal edges of the frame, which cooperate with correspondingly designed surfaces on an internal contour of the cursor so that the borehole can be accurately located for marking a fastener point at a desirable location on a wall surface.

As another example, U.S. Pat. No. 6,473,983 to Gier discloses a tool for marking a pair of points on a horizontal line. The tool has a standard ruler onto which is slidably attached a first member, a leveling member, and a second member. The first member is used to mark the first point on a wall surface, and the device pivots at the first member. The user then uses the leveling member to determine when the first member is level with the second member. When level status is obtained, the user is able to mark the wall surface at the second member, thereby marking a pair of points on a horizontal line.

Each of the above devices effectively solves the basic problems of ocating attachment points at desired locations, and getting a fixture hung on a wall at a desired (level) orientation. However, in order to establish attachment points at a sufficient spacing to support a range of fixture sizes, each of the above devices is lengthy and thereby somewhat unwieldy. Thus, each of these known devices presents a two-fold problem in marketing and in storage: how to fit one or more of the devices into a limited space alongside numerous other products or devices.

In view of the foregoing, there is a need for an extensible and collapsible device for establishing two or more attachment points on a wall surface, such that multiple attachment points can be located in a single procedure for attaching a fixture to the wall surface at a desired location and (level) orientation, regardless of relative position between attachment points, without compromising the size, design, or operation of the device. Further, it is desirable that before and after use, the device can be collapsed to a suitable size for storage.

Accordingly, it is a general object of the present invention to provide an extensible apparatus for locating attachment points, which improves upon conventional levels currently on the market and that overcomes the problems, drawbacks, and limitations associated with such prior art levels and other devices for locating attachment points on vertical wall surfaces.

SUMMARY OF THE INVENTION

In accordance with the present invention, an apparatus for locating attachment points is provided as an extensible locating device.

In one aspect of the invention, the apparatus has a first end piece with a flat rearward face for placement against a wall. From the first end piece, a main track extends to its distal end in parallel with the flat rearward face of the first end piece. At least one auxiliary track extends along the main track, and can be extended distally from the main track to increase the length of the locating device. A auxiliary end piece is fixed to the distal end of the auxiliary track. A main shuttle is slidably movable along the main track, and an auxiliary shuttle is slidably movable along the auxiliary track. Each shuttle includes a rearwardly protruding marker.

These and other objects, features and advantages of the present invention will become apparent in light of the detailed description of the best mode embodiment thereof, as illustrated in the accompanying drawings.

DETAILED DESCRIPTION OF THE DRAWINGS

Figure 1:
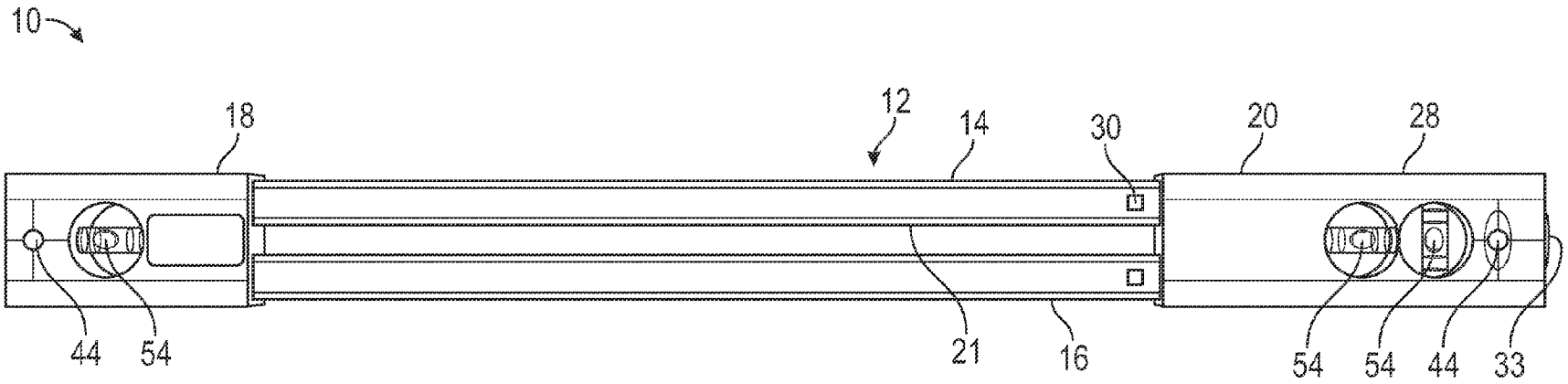
FIG. 1 shows a plan view of an extensible apparatus for locating attachment points, in a collapsed condition, according to an embodiment of the present invention.
Figure 2:
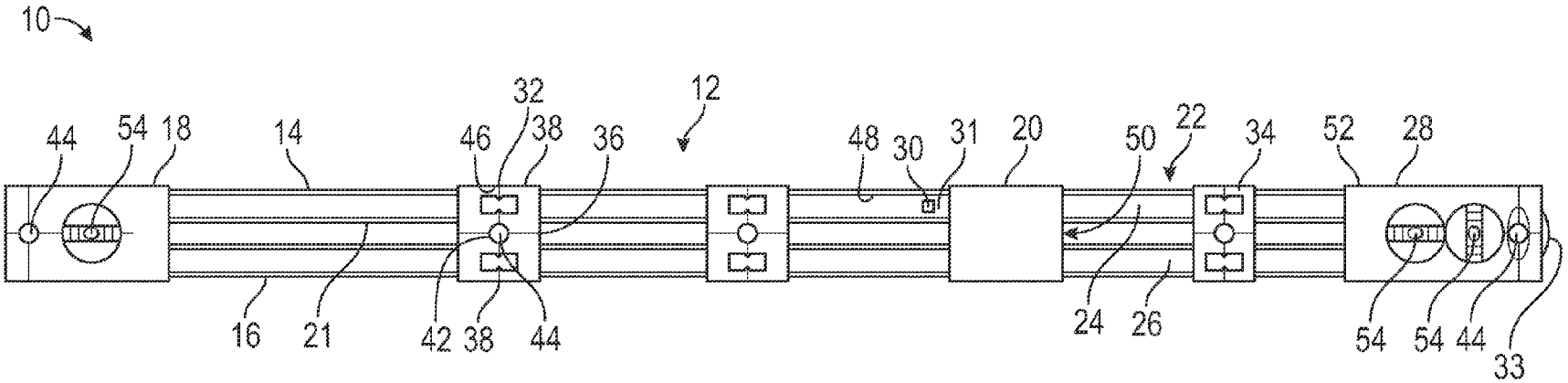
FIG. 2 shows a perspective view of the extensible apparatus shown in FIG. 1, in an extended condition.

FIGS. 1 and 2 show an extensible locating device 10 for locating attachment points on a surface, preferably a vertical wall surface, to facilitate level hanging of a wall-mounted fixture in accordance with an embodiment of the invention. The device or apparatus 10 includes a main track 12 that has a first end piece, a auxiliary end piece, and a longitudinal axis therebetween. The main track 12 is formed by first and second parallel main rails 14, 16 that extend from proximal ends attached in the first end piece 18 to distal ends attached in a second end piece 20. The main rails 14, 16 are laterally spaced apart from one another by a medial gap or space 21.

The main track 12 slidably receives an auxiliary track 22. The auxiliary track 22 is formed by first and second auxiliary rails 24, 26 that extend in parallel through the second end piece 20, from proximal ends overlapping within the main rails 14, 16 to distal ends enclosed in a auxiliary end piece 28.

The main and auxiliary tracks 12, 22 are connected so that the auxiliary track can slide between an extended condition and a collapsed condition of the apparatus 10. FIG. 1 shows the apparatus 10 in its collapsed condition, where proximal ends of the auxiliary rails 24, 26 are near the first end piece 18 at the proximal ends of the main rails 14, 16, and the auxiliary end piece 28 abuts the second end piece 20. Of note in FIG. 1, near the distal ends of the main rails 14, 16 there are catch reliefs 30.

FIG. 2 shows the extended condition of the apparatus 10, where proximal ends of the auxiliary rails 24, 26 overlap distal ends of the main rails 14, 16, and the auxiliary end piece 28 is displaced away from the second end piece 20. Thus, the auxiliary track 22 is telescopically extensible out from the distal end of the main track 12.

In another embodiment, the main rails have flattened rearward faces and the auxiliary rails have flattened forward faces slidably abutting the rearward faces of the main rails. In this alternate embodiment, the second end piece 20 is fixed to distal ends of the main rails and slidably holds the auxiliary rails. The cuff may include catch reliefs 30 for preventing complete removal of the auxiliary rails.

Because the extensible apparatus 10 is movable between collapsed and extended conditions, in a select embodiment, it is possible to fit the apparatus into a hanging shelf display of no more than about 18" height while nonetheless providing for up to 34" spacing between attachment points when the apparatus is extended to its full effective length. Thus, it is possible in any embodiment to position the extensible apparatus 10 within an existing commercial display or storage space, more easily than would be possible for a non-extensible apparatus of the same effective length.

In other embodiments, duplicate auxiliary tracks 22 are provided at each end of the main track 12. One of the duplicate auxiliary tracks 22 may telescope inside the other, such that the extensible device or apparatus 10 can be nearly tripled in length from its collapsed condition to its fully extended condition.

It has been noticed that, when hung up, the auxiliary track 22 tends to slide toward its extended condition. Accordingly, as shown in FIG. 2, outward-biased catch fingers 31 are formed on the auxiliary rails 24, 26, for engaging the catch reliefs 30 to prevent the auxiliary rails sliding all the way out of the main rails. The catch fingers can, however, be released by inward pressure to permit removing the auxiliary rails from the main rails. In certain embodiments, the catch fingers 31 deflect inward when the auxiliary track 22 is pushed toward the collapsed condition. In other embodiments, the catch fingers 31 can be deflected inward by operation of a button 33 that is disposed on the auxiliary end piece 28, according to a conventional push-release mechanism (not shown) that is housed within the auxiliary end piece 28. In most embodiments, while the auxiliary track 22 is moved in either direction between the collapsed condition and the extended condition, the catch fingers 31 provide frictional drag that tends to keep or hold the auxiliary track at any desired intermediate position.

Still referring to FIG. 2, the main track 12 and the auxiliary track 22 extend along the medial space 21. At least one shuttle 32 is provided on the main track 12 while another shuttle 34 is provided on the auxiliary track 22.

Figure 3:
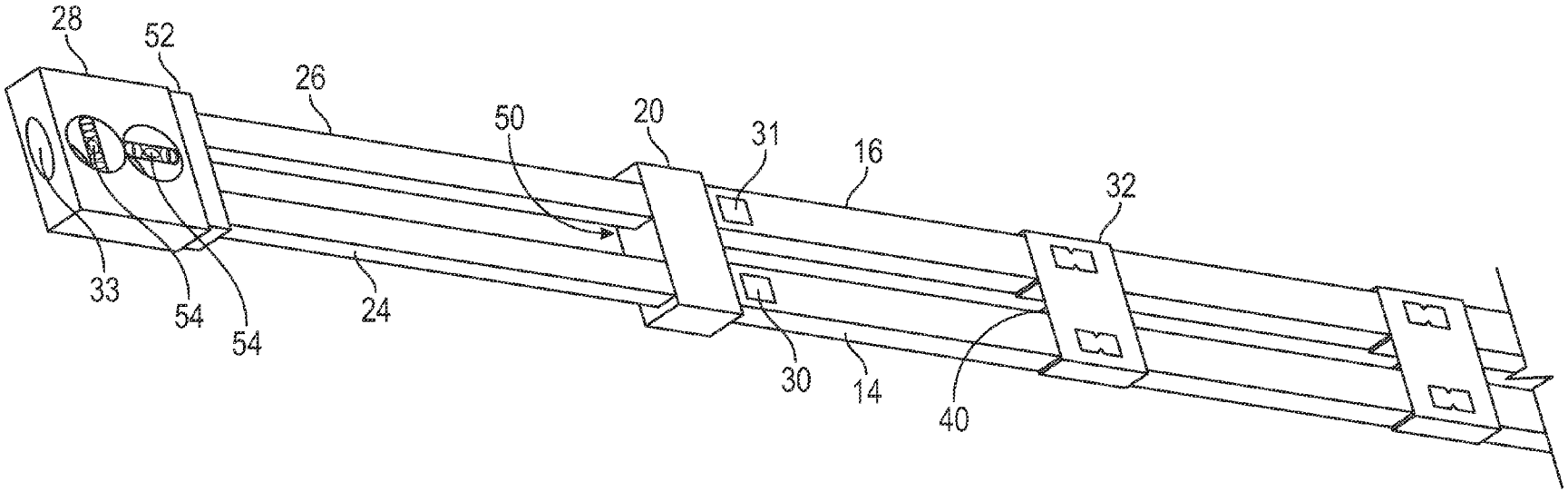
FIG. 3 shows a detail view of a cuff portion of the extensible apparatus shown in FIGS. 1 and 2.

FIG. 3 shows details of the shuttles 32, 34 that are provided on the apparatus 10. Each shuttle 32, 34 includes a web 36 that spans the medial space 21 and removably engages each rail of its respective track. For example, each shuttle includes concave flanges 38 that are formed at opposed edges of the web 36. The concave flanges protrude substantially orthogonally from the web 36 for gripping outward edges of the rails on which the shuttle is mounted. Additionally, each shuttle 32, 34 includes fingers 40 (FIG. 3) that protrude from the web 36 into the medial space 21 for gripping laterally opposed inward edges of the rails on which the shuttle is mounted. The shuttles 32, 34 differ principally in dimensions of their respective webs 36 and flanges 38, with the shuttle 34 having relatively narrower dimensions to fit the narrower dimensions of the auxiliary track 22.

Each shuttle 32, 34 also includes a marker 42 that protrudes rearward from the web 36. For example, the marker 42 protrudes perpendicularly from the web through the medial space 21. In such an embodiment, outer edges of the main and auxiliary tracks 12, 22 are kept generally smooth without protrusions or snags. The marker includes an aperture 44 for receiving and guiding a stylus, crayon, pen, pin, or other tool for marking a wall. Although one purpose of the present invention is to establish level attachment points on a wall, in certain aspects of the invention, the extensible device or apparatus 10 may also be used for establishing level between selected points on a floor or other horizontal surface.

Each shuttle 32, 34 also includes at least one indexing window 46 that overlies one of the rails on which the shuttle is slidably mounted. Each indexing window exposes measurement indicia 48 that are marked on the rails for the purpose of positioning the shuttles 32, 34.

In the embodiment of FIGS. 1 and 2, the auxiliary track 22 is slidably housed within the main track 12. Accordingly, outward edges of the auxiliary track 22 are closer together than are the outward edges of the main track 12. Also, inward edges of the auxiliary track 22 are farther apart than are the inward edges of the main track 12.

Figure 4:
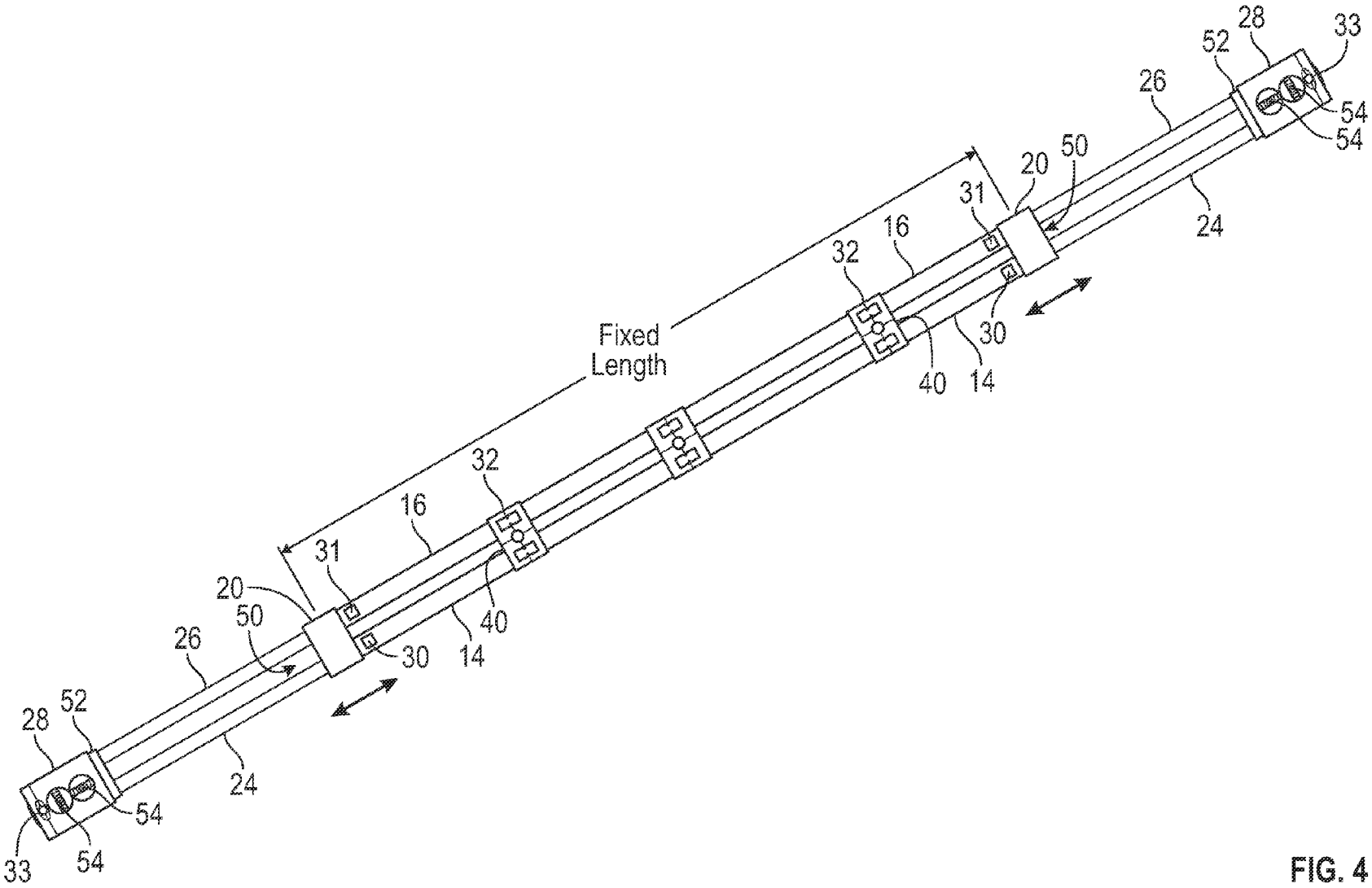
FIG. 4 shows a perspective view of a double-ended extensible apparatus according to another embodiment of the invention.

As one solution to a problem of storing the at least one auxiliary shuttle 34, FIG. 4 shows in perspective view a hollowed portion 50 of the cuff 18 and a narrowed part or neck 52 of the auxiliary end piece 28. In the collapsed condition of the apparatus 10, the neck 52 of the auxiliary end piece slides into the hollowed portion or cavity 50 of the cuff. Additionally, the shuttle 34 may also slide into the cavity 50 adjacent to the neck 52 of the auxiliary end piece. As the shuttle 34 rides with some friction on the auxiliary rails 24, 26, it can be retrieved from the cavity 50 by pulling out the auxiliary end piece 28.

Referring back to FIG. 1, each of the first end piece 18 and the auxiliary end piece 28 includes an aperture 44 as well as at least one level 54. The end pieces 18, 28 have flat rearward faces (at the narrower openings of the apertures 44) for placement against a wall. Each of the levels 54 may be any of a bubble level, a ball bearing level, an electronic level, a plumb bob, or any other mechanism that will indicate the apparatus 10 is in a level position. In embodiments, one of the levels is a horizontal level that is aligned to the longitudinal axis of the device or apparatus 10, while another of the levels is a plumb level that extending laterally across the apparatus 10 (generally orthogonal to the horizontal level). In some embodiments, one or more of the levels 54 may be made rotatable with reference to fixed marks on one or both of the end pieces 18, 28.

While the extensible apparatus 10 can be constructed from any suitably rigid materials, in select embodiments, the rails may be extruded from aluminum or from rigid plastic with high fatigue life while the cuff, shuttles, and end pieces are injection molded of ABS or similar plastic. The end pieces and cuff can be made of two halves (front and back) that are snapped onto the rails.

FIG. 4 shows another embodiment of the extensible apparatus 10, which is double-ended, that is, provided at each end with an auxiliary track 22. The two auxiliary tracks in their retracted conditions may abut each other, or may nest within each other telescopically.

Although this invention has been shown and described with respect to the detailed embodiments thereof, it will be understood by those skilled in the art that various changes in form and detail thereof may be made without departing from the spirit and the scope of the invention.

What is claimed is:

1. An extensible apparatus for locating attachment points, comprising:

a first end piece with a flat rearward face for placement against a wall;

a main track fixed at a first end to the first end piece and extending, in parallel with the flat rearward face of the first end piece, from the first end piece to a second end of the main track;

an auxiliary track attached at the second end of the main track, and slidably movable along the main track between a fully extended condition of the apparatus and a collapsed condition of the apparatus;

an auxiliary end piece attached at an end of the auxiliary track distal from the main track;

a main shuttle slidably movable along the main track between the first and second end pieces; and an auxiliary shuttle slidably movable along the auxiliary track between the second end piece and the auxiliary end piece;

wherein each shuttle includes a rearwardly protruding marker.

2. The apparatus of claim 1, wherein each shuttle includes rearwardly curved flanges at first and second lateral ends of the web for gripping outward edges of the corresponding track.

3. The apparatus of claim 1, wherein at least one of the tracks is marked with indicia of distance, and the respective shuttle includes an indexing window overlying the indicia.

4. The apparatus of claim 1, wherein each shuttle includes an aperture formed from front to back through the marker.

5. The apparatus of claim 1, wherein each of the main and auxiliary tracks includes two parallel rails that are spaced apart from each other by a medial gap, and the marker of each respective shuttle protrudes rearwardly through the medial gap of the respective track.

6. The apparatus of claim 1, wherein at least one of the end pieces houses a level indicator.

7. The apparatus of claim 6, wherein the level indicator is housed within an aperture formed in the end piece.

8. The apparatus of claim 7, wherein the level indicator is rotatably adjustable within the aperture.

9. The apparatus of claim 1, wherein the main track includes a relieved portion proximate its distal end, and the auxiliary track includes an outwardly biased catch for engaging the relieved portion of the main track to prevent extension of the auxiliary track beyond a fully extended condition of the apparatus, and to prevent collapsing the auxiliary track from the fully extended condition of the apparatus.

10. The apparatus of claim 9, wherein the relieved portion is a through hole and the catch is operable via the through hole to permit collapsing the auxiliary track from the fully extended condition of the apparatus.

11. The apparatus of claim 9, wherein the catch is operable, via a button disposed at an end piece of the auxiliary track, to permit collapsing the auxiliary track from the fully extended condition of the apparatus.

12. The apparatus of claim 1, wherein a cuff is fixed to the distal end of the main track, and the auxiliary track is extensible from a collapsed condition where the auxiliary end piece abuts the cuff to an extended condition where a proximal end of the auxiliary track is adjacent the cuff.

13. The apparatus of claim 12, wherein the cuff has at its distal end a hollowed portion for receiving a neck of the auxiliary end piece.

14. The apparatus of claim 12, wherein the hollowed portion of the cuff is configured to receive at least one second shuttle that is held on the auxiliary track.

15. An extensible apparatus for locating attachment points, comprising:

a main track that extends along a longitudinal axis from a first end to a second end;

a first auxiliary track attached at the first end of the main track, and slidably movable along the main track between extended and collapsed conditions of the first auxiliary track;

a second auxiliary track attached at the second end of the main track, and slidably movable along the main track between extended and collapsed conditions of the second auxiliary track;

first and second auxiliary end pieces attached at ends of the respective auxiliary tracks that are distal from the main track, wherein each end piece has a flat rear face suitable for placement against a wall surface;

a main shuttle slidably movable along a front face of the main track between the first and second ends thereof; and an auxiliary shuttle slidably movable along a front face of one of the first or second auxiliary tracks between the respective auxiliary end piece and the respective end of the main track;

wherein each shuttle includes a rearwardly protruding marker that has an aperture formed from front to back therethrough, and the extended conditions of the first and second auxiliary tracks together provide a fully extended condition of the apparatus.

16. The apparatus of claim 15, wherein at least one of the tracks is marked with indicia of distance, and the respective shuttle includes an indexing window overlying the indicia.

17. The apparatus of claim 15, wherein each of the main and auxiliary tracks includes two parallel rails that are spaced apart from each other by a medial gap, and the marker of each respective shuttle protrudes rearwardly through the medial gap of the respective track.

18. The apparatus of claim 15, wherein at least one of the end pieces houses a level indicator.

19. The apparatus of claim 15, wherein at least one of the auxiliary tracks includes a catch for engaging the main track to prevent extension of the auxiliary track beyond its extended condition, and to prevent collapsing the auxiliary track from its extended condition to its collapsed condition.

20. The apparatus of claim 19, wherein the catch is operable, via a button disposed at an end piece of the auxiliary track, to permit collapsing the auxiliary track from its fully extended condition.

* * * * *